US007299579B2

(12) United States Patent
Lowry

(10) Patent No.: US 7,299,579 B2
(45) Date of Patent: Nov. 27, 2007

(54) LABEL/SIGN HOLDER WITH BUMPER

(75) Inventor: Michael G. Lowry, Boca Raton, FL (US)

(73) Assignee: Fast Industries, Ltd., Fort Lauderdale, FL (US)

( * ) Notice: Subject to any disclaimer, the term of this patent is extended or adjusted under 35 U.S.C. 154(b) by 255 days.

(21) Appl. No.: 11/067,903

(22) Filed: Mar. 1, 2005

(65) Prior Publication Data

US 2005/0193612 A1 Sep. 8, 2005

Related U.S. Application Data

(60) Provisional application No. 60/548,869, filed on Mar. 2, 2004.

(51) Int. Cl.
*G09F 3/18* (2006.01)

(52) U.S. Cl. ..... 40/661.03; 40/642.02

(58) Field of Classification Search ..... 40/661.03, 40/647.02; D20/44, 43
See application file for complete search history.

(56) References Cited

U.S. PATENT DOCUMENTS 4,485,575 A 12/1984 Fast
4,531,313 A 7/1985 Fast
4,625,441 A 12/1986 Fast
4,704,813 A 11/1987 Fast
4,713,899 A 12/1987 Fast
4,917,342 A 4/1990 Fast
4,995,182 A 2/1991 Fast
5,458,307 A 10/1995 Gebka
5,488,793 A 2/1996 Gebka et al.
5,515,632 A 5/1996 Gebka et al.
5,682,698 A 11/1997 Bevins
5,899,011 A 5/1999 Brinkman
6,026,603 A * 2/2000 Kump et al. ..... 40/661.03
6,105,295 A 8/2000 Brinkman et al.
6,163,996 A 12/2000 Gebka
6,568,112 B2 * 5/2003 Lowry et al. ..... 40/661.03
6,688,567 B2 * 2/2004 Fast et al. ..... 248/220.41
2004/0262470 A1 12/2004 Lowry et al.
2005/0016039 A1 * 1/2005 Abramson ..... 40/611.01

* cited by examiner

*Primary Examiner*—Cassandra Davis
(74) *Attorney, Agent, or Firm*—Jacobson Holman PLLC

(57) ABSTRACT

A merchandising shelf label holder, particularly for holding or carrying an electronic shelf label (ESL), with an integral protective mechanism, including a bumper to withstand impacts from shopping carts and the like. The bumper includes a substantially semicircular bulbous section extending in a direction away from the shelving and further away from the shelving than the ESL and that curves back toward the shelving with a vertical plate that is in contact with the shelving or extension thereof. The protective mechanism also includes a rear support stop member that engages the label holder when impacted.

11 Claims, 6 Drawing Sheets

LABEL/SIGN HOLDER WITH BUMPER

This is a complete application claiming benefit of provisional application Ser. No. 60/548,869 filed Mar. 2, 2004.

BACKGROUND OF THE INVENTION

1. Field of the Invention

This invention relates to merchandising aids, and relates more particularly to the manner and means by which a label holder including, in particular, an electronic shelf label (ESL) carrier, when secured to a merchandising shelf at a location where it is subjected to impact by shopping carts and the like, is protected from such impact. The label holder includes an integral bumper to withstand the impacts. For simplicity, the terms "label holder", "label/sign holder" and "label carrier" are used interchangeably to include label holders with or without one or more means to also carry a sign or flag and to also include ESL carriers that include an ESL holder (with or without a cover) and an ESL attachment member, as discussed below.

2. Description of the Related Art

Consumer-oriented product information labels are commonly found in supermarkets, drug stores, and the like and provide purchasers with the unit price, promotional and nutritional information, and the like and, also, commonly include bar codes or other inventory control information for the use of the store personnel. Such information may be carried on paper or plastic labels secured directly to the side of a shelf unit or the front edge of a merchandise shelf, but the use of adhesively-backed labels has obvious disadvantages in the constantly changing commercial environment found in today's marketplace. More often, plastic label holders are provided which are adapted to removably receive and display the labels in a well known manner.

Such label holders are generally provided in elongated sections, perhaps 4' or more in length, and may be secured by adhesive strips or the like to any supporting surface such as the side of a shelving or warehouse unit. However, most applications for such label holders are directly on the front flange or in the C-channel of the front edge of a product display shelf. Various prior art embodiments of such label holders can be seen in U.S. Pat. Nos. 4,713,899, 5,458,307, 5,488,793, 5,515,632, 5,682,698, 5,899,011 and 6,105,295, the disclosures of which are incorporated herein in their entireties by reference.

Oftentimes, in addition to the information provided by the product labels, it is desired to highlight certain information about a particular product or group of products by displaying an enlarged "flag" or sign on the shelf, depending from the portion of the shelf carrying such products, or extending into the aisle at such a location. Different forms of "sign holders" are also well known in the merchandising art, examples of which can be seen in the aforementioned U.S. Pat. No. 5,488,793, as well as U.S. Pat. Nos. 4,485,575, 4,531,313, 4,625,441, 4,704,813, 4,917,342, 4,995,182, 5,682,698, and 6,163,996, the disclosures of which are also incorporated herein in their entireties by reference.

Still further, combined label and sign holders are available, such as are disclosed in U.S. Pat. No. 6,568,112, the disclosure of which is incorporated by reference herein, and the OMNI™ channel system of Fast Industries which is available in embodiments that attach to C-channels or directly to a supporting surface by double-sided tape or similar adhesive.

More recently, in place of, or in addition to, such paper or plastic information containing labels, electronic information carriers have been employed. Electronic shelf labels (ESLs) are generally integrated with the in-store processor (ISP) or a free-standing controller that communicates with file information supporting the store's point-of-sale system. The ESL system may include low-voltage communication electronics or communication base stations (CBS) located in store ceilings away from the store operations. The ESLs are positioned throughout the store to identify an item's retail price and other information of interest to the consumer or for use by the store's inventory system. These ESL units, however, much like paper labels, require a carrier device to facilitate supporting them at selected locations, usually on the front of a store merchandise shelf. The ESL carrier may be of three components, the ESL holder, a cover for the holder (optional), and an attachment member that supports the ESL holder and attaches directly to a support surface of the merchandise shelf such as a C-channel. See U.S. patent application Ser. No. 10/448,049 filed May 30, 2003, the disclosure of which is incorporated by reference herein.

Each of the above label holders, sign holders, combined label and sign holders, and ESL carriers may be attached or affixed to a supporting surface of a merchandising shelf through various arrangements. Generally, these arrangements might include a C-channel with which the attachment member of the label holder or carrier may be releasably secured. In situations where a C-channel is lacking, generally the attachment is made directly to a supporting surface of the merchandising shelf in a fixed manner, such as by adhesive or double-sided tape.

When label holders are mounted near floor level, they are subject to damage by customers' shopping carts, as well as stock carts of employees during merchandise replenishment. With the advent of ESLs, a heightened need has arisen to protect label holders from such damage.

SUMMARY OF THE INVENTION

It is a primary object of the present invention to provide a means for protecting label holders, and particularly ESL carriers, from damage being inflicted by impact with customers and their shopping carts, as well as impact from stock carts during merchandise replenishment.

It is an object of the present invention to provide a protective protuberance, such as a bumper, that is disposed outward from the position of the label holder (i.e., away from the shelving and in a direction into the aisle) to intercept the shopping cart and protect the label holder from collision with a shopping cart.

Still further, it is an object of the present invention to directly integrate the bumper with the label holder so that the bumper is always positioned in an effective and predetermined position with respect to the label holder when it is mounted in, preferably, a C-channel of the type typically used for merchandising.

Other and further objects, features, and advantages in the invention will become apparent from the ensuing description taken in conjunction with the attached drawings.

BRIEF DESCRIPTION OF THE DRAWINGS

Like reference characters refer to like parts throughout the several views of the drawings.

DESCRIPTION OF THE PREFERRED EMBODIMENTS

Figure 1:
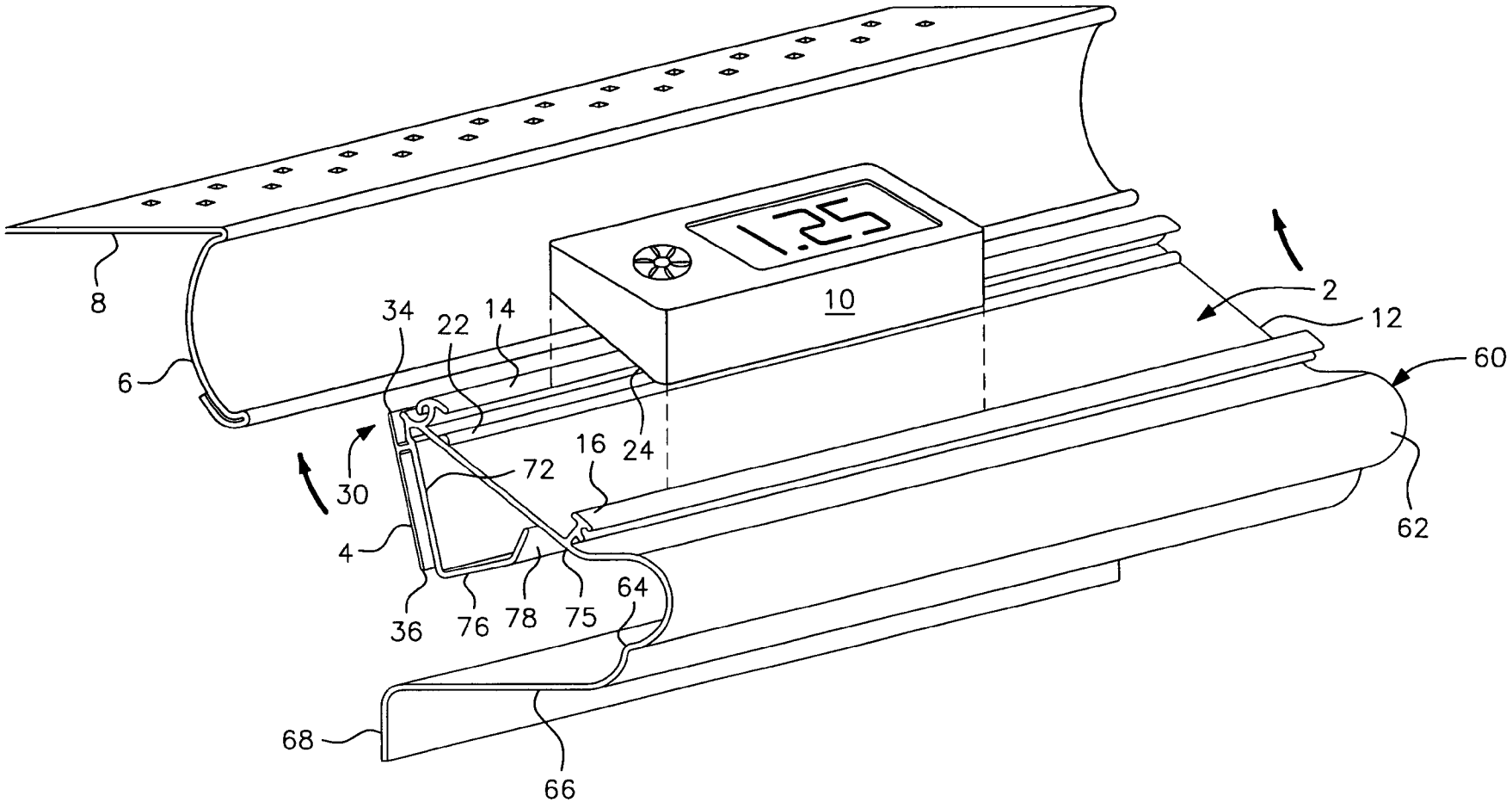
FIG. 1 is an exploded perspective view of an ESL and ESL carrier, including an ESL holder with the integral novel bumper and rear support element of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

The embodiments of FIGS. 1-4 provides for an ESL holder 2 with an attachment member 4 for attaching the ESL holder to a typical C-channel 6 used on merchandise shelving 8. With reference to FIG. 1, the ESL unit 10 is shown in an exploded view with respect to the ESL holder 2. Many arrangements for connecting or coupling the ESL 10 with an ESL holder 2 are known in the art. In the depicted embodiment, the ESL holder 2 includes a back mounting plate 12 with ESL lip members 14, 16 to retain the ESL 10 within the holder 2. The ESL includes complementary slots 18, 20 in the side edges of the ESL near its rearward surface that engage with the lips 14, 16 of the back mounting plate 12. The back mounting plate 12 includes a bead 22 that is resilient with respect to the material of the overall holder itself and the back 24 of the ESL is intended to rest upon the bead 22 to provide a tight interconnection between the bead 22 and the adjacent lip 14.

The overall length from end to end of the holder 2 may vary, but may be up to 4' in length or longer.

The ESL holder 2 includes an attachment member 4 comprising a vertically extending rear panel element 30 attached to the back of an L-shaped rear support stop member 70 by a horizontal connection 32; the upper and lower edges 34, 36, respectively, can be snapped and engaged between the upper and lower lips of a C-channel 6. This attachment structure is known in the art and is generally referred to as an H-back interface. Obviously, other structures for attaching the ESL holder to the C-channel can be utilized, including universal back interfaces 50 as shown in FIG. 8(*b*). Any structure for attaching the ESL 10 to the back mounting plate 12 of an ESL holder 2 and the specific structure for attaching the overall holder 2 to a C-channel 6 can be utilized.

The ESL label holder, as well as the other label holders to be described, is extruded from rigid PVC and its thickness is 0.040 inches in a typical preferred embodiment. The rear panel attaching element 30 is generally thinner and more flexible for insertion into the C-channel. Typically, the rear panel element 30 may be 0.022 inches or approximately one-half the thickness of the extruded PVC thickness portions of the label holder 2. The rear panel element 30, as best shown in FIG. 2, snaps into the C-channel where its profile conforms to that of the C-channel holding the ESL holder in place.

Figure 4:
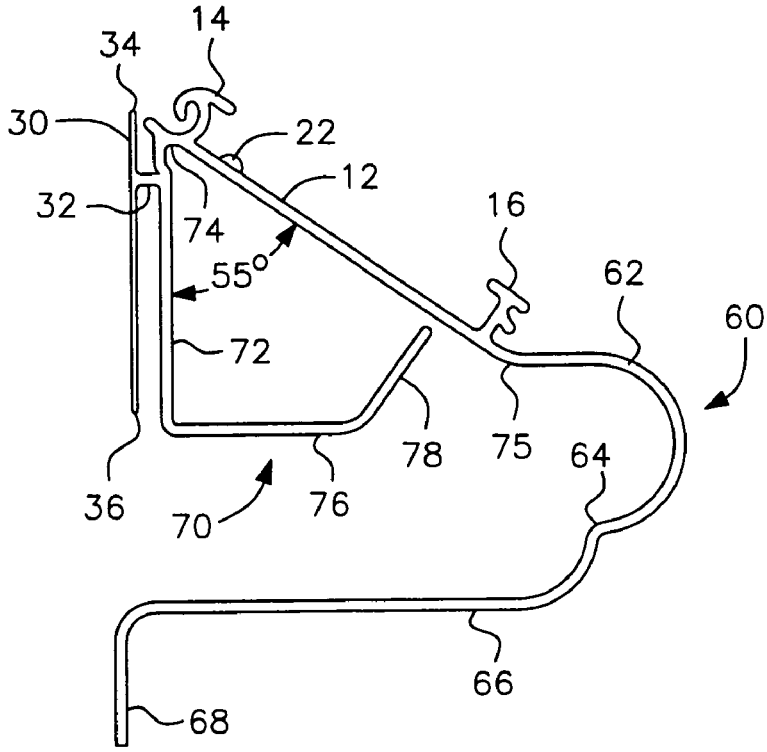
FIG. 4 is a side, i.e., end, view of the ESL holder of the present invention with the novel bumper and rear support element.

Integral with and extruded with the back mounting plate 12 is the novel bumper structure 60 for protecting the label and, particularly, the ESL 10, from impact. The protective system also includes a substantially L-shaped rear support stop member 70 that includes a first arm plate 72 extending from the top portion 74 of the back mounting plate 12 at an acute angle, such as 55°, therefrom. At the bottom end of the first arm 72, preferably perpendicular thereto, is a second arm plate 76 that includes a third leg plate member 78 extending upwardly at an obtuse angle with respect to the second leg plate 74, in a direction toward the back mounting plate 12. As best shown in FIG. 4, the obtuse angle is approximately 125°. Preferably, the third leg plate 78 is directed perpendicular to the back mounting plate 12 and is closely spaced apart from the plate 12. The angular relationship is approximate only and can deviate slightly (see FIG. 2) without departing from the functional requirements of the invention.

Figure 2:
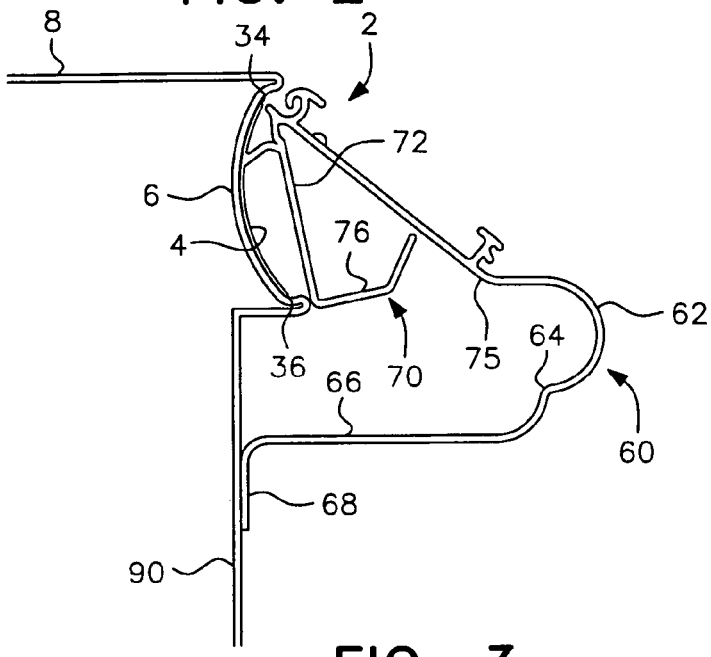
FIG. 2 is a cross-sectional view of the novel ESL holder attached to a shelving C-channel.

Integrally extruded from the bottommost end 75 of the back mounting plate 12 is an arcuate, bulbous bumper 60 substantially semicircular in cross-section at 62 that includes an indented small radius inward arc 64 that turns into a substantially planar plate 66, preferably substantially parallel to the second arm plate 76, although deviations from parallel are certainly permitted (see FIG. 2). The arc 64 enables flexure and adds strength to the curvature portion 62. The semicircular bumper is intended to receive impacts and the indentation serves to strengthen the bumper area. Extending downward from the rear end of the plate 66 is a substantially perpendicular oriented extension arm 68 that is substantially parallel with the first arm plate 72 (but, see, FIG. 2 where deviations from parallel are permitted).

Figure 3:
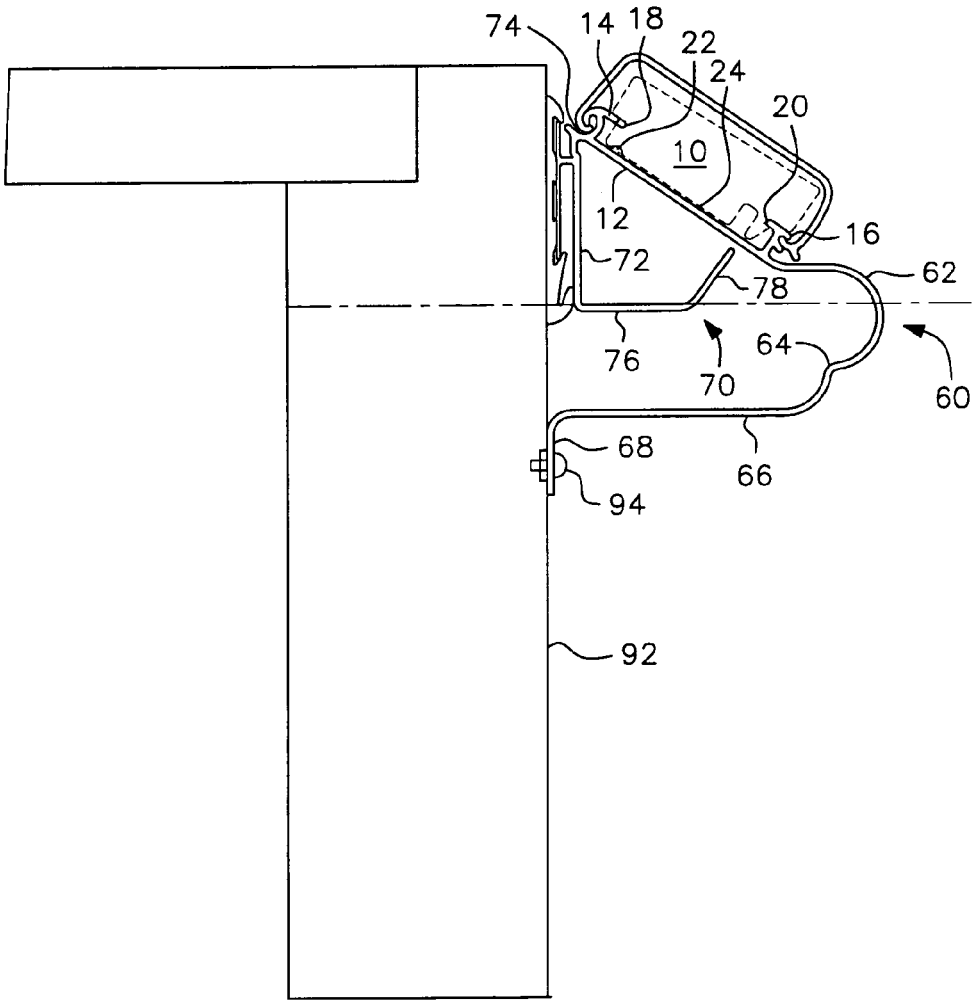
FIG. 3 is an end view of the novel ESL holder in combination with the C-channel and pallet rack vertical cross-bar structure.

It will be appreciated that a typical merchandise shelf will include vertically oriented bars or posts periodically disposed at various locations along the shelf length. In FIG. 2, a vertical shelf extension 90 is shown schematically. The arm 68 of the holder 2 rests on the vertical extension 90. This is not critical, however. In some instances, a space will exist between the arm 68 and the vertical extension 90 which may close by the weight of the ESL 10 when the ESL is inserted into the holder. In some instances, even with the ESL inserted, a spacing may exist, at least until contact with a shopping cart takes place. In FIG. 3, a pallet rack crossbar 92 is depicted and the arm 68 may be screwed, bolted or riveted at 94 to the vertically oriented pallet rack bar 92.

When a shopping cart or other stock or grocery cart impacts against the bumper 60, the back mounting plate 12 will pivot about its top portion 74 and impact the third leg plate 78 which in turn will cause the entire L-shaped rear support stop member 70 to move angularly and into contact with the lower lip edge of the C-channel 6. This will be the furthestmost rearward limit of the label holder 2, other than flexure that will take place for more severe impacts. Flexure may take place along the small radius inward arc 64, for example, or the bumper portion 62 itself could distort. Most importantly, the impact will not be directed against the ESL 10 itself and the geometry of the holder is such that the ESL is oriented so that the furthest most extension of the bumper at 62 lies substantially further away from the shelf than any portion of the ESL 10.

For the most effective protection, the holder 2 with the integral bumper 60 is placed at a location vertically where it will receive the impact of the shopping cart. That is, it should not be so low that the shopping cart will ride over the top edge of the bumper and strike the ESL directly. Of course, the exact height of the mounting could vary depending upon the merchandise shelf design and, most importantly, the heights of the various shopping carts or other grocery or stock cart vehicles in use at any particular location. This optimum mounting height can be changed provided by utilizing a separate C-channel (not shown) that can be mounted to the vertical posts associated with the shelving at the desired location off the floor.

Figure 7:
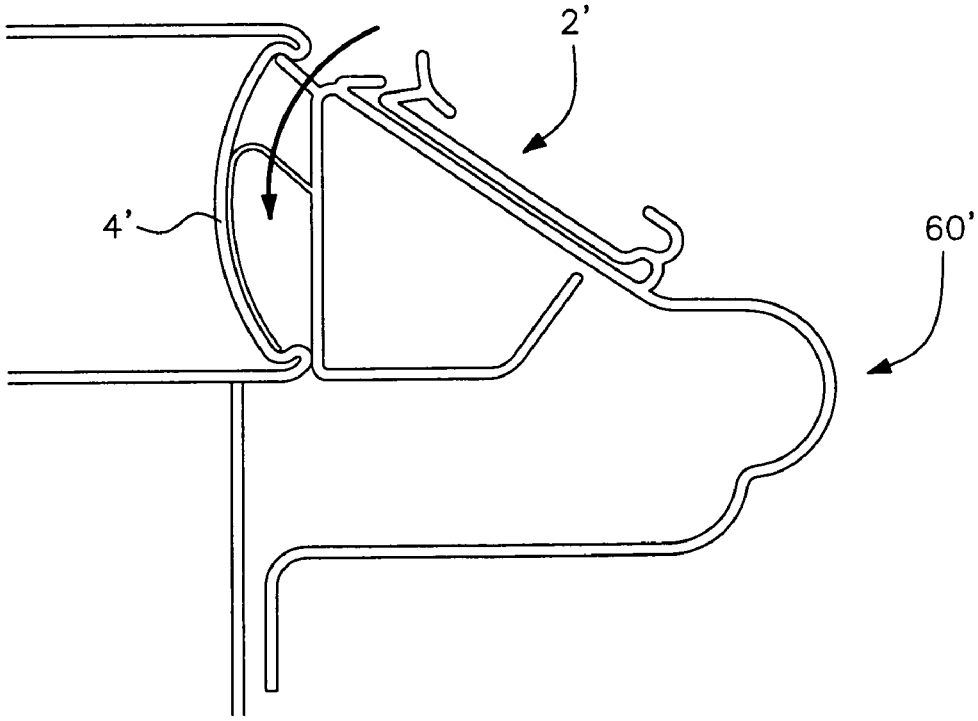
FIG. 7 is a cross-sectional view of the label/sign holder of FIG. 6 inserted into a C-channel.
Figure 5:
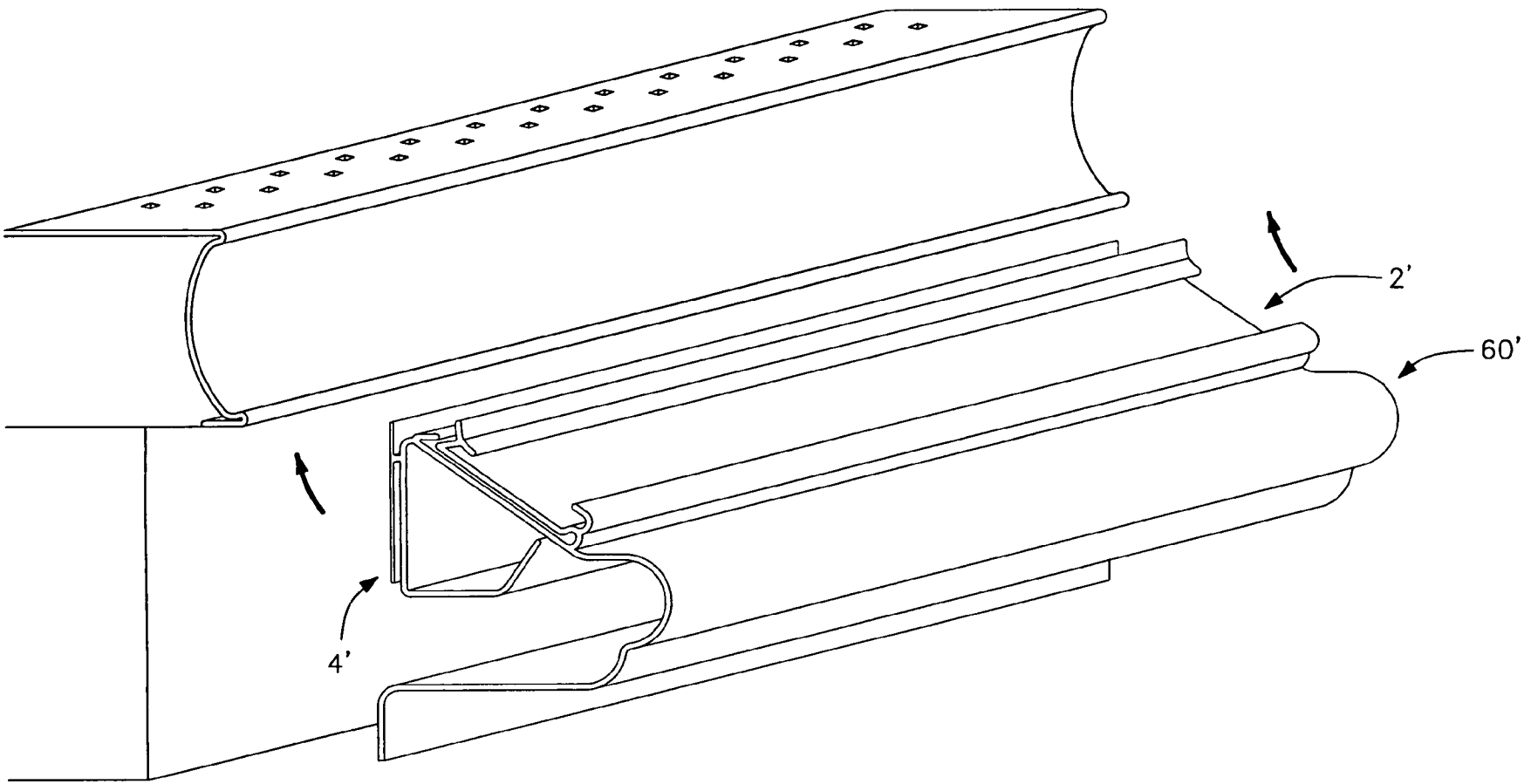
FIG. 5 is an exploded perspective view of a combined label/sign holder integral with the bumper and rear support structure of the present invention.
Figure 6:
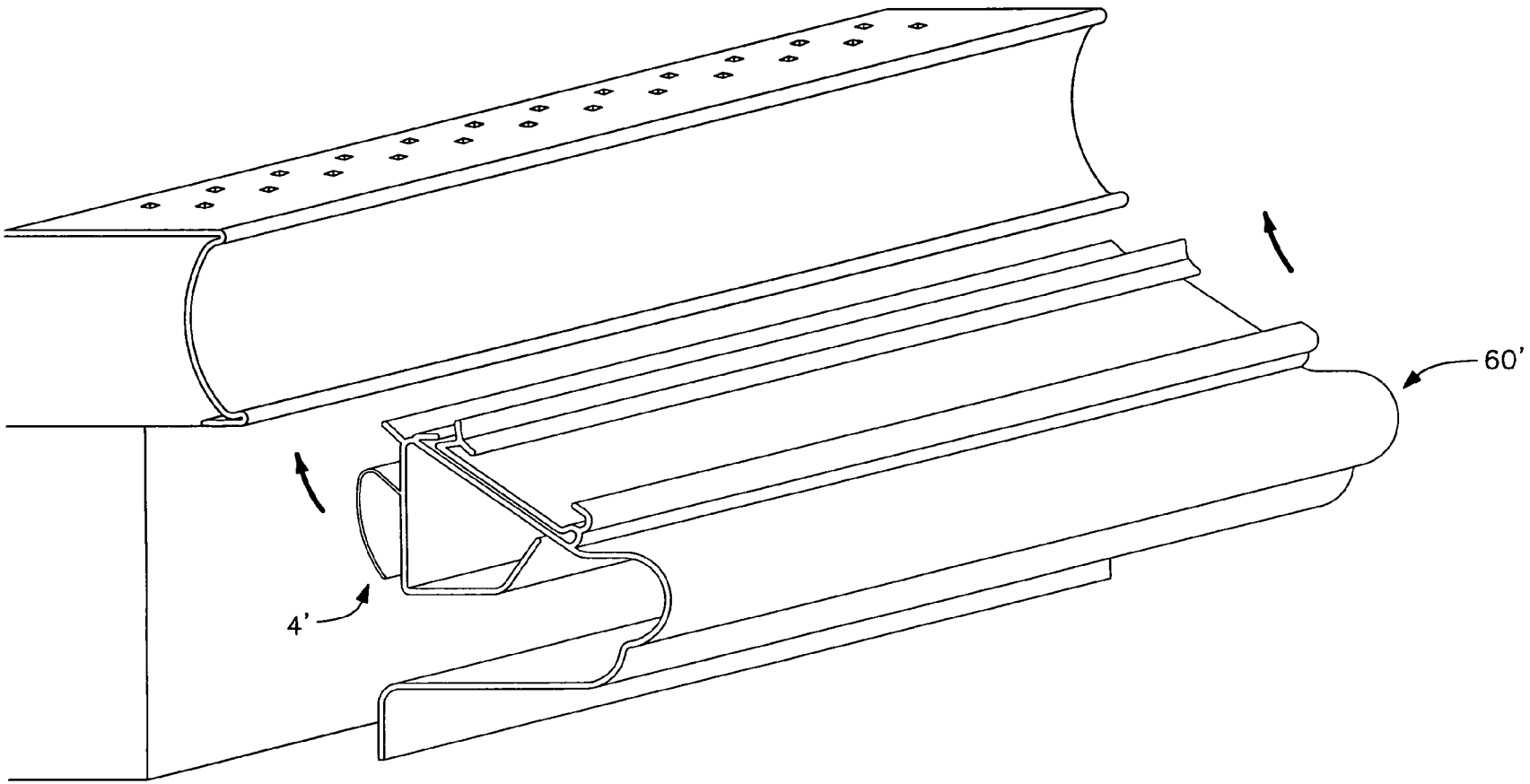
FIG. 6 is an exploded perspective view of a combined label/sign holder with the novel bumper and rear support member with a universal back interface for interconnection with a C-channel.
Figure 8A:
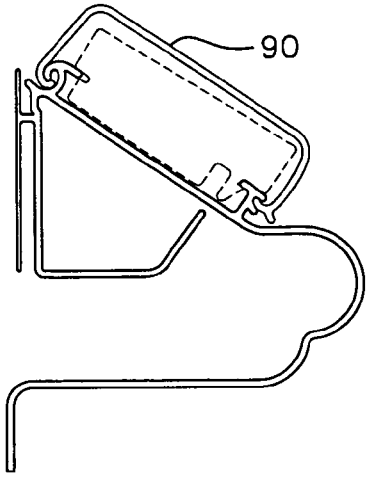
FIGS. 8(*a*)-8(*f*) are end views of an ESL holder, a combined label/sign holder, and a standard label holder, each with the novel bumper and rear support member structure of the present invention and with two different interfaces for interconnection with a C-channel.
Figure 8B:
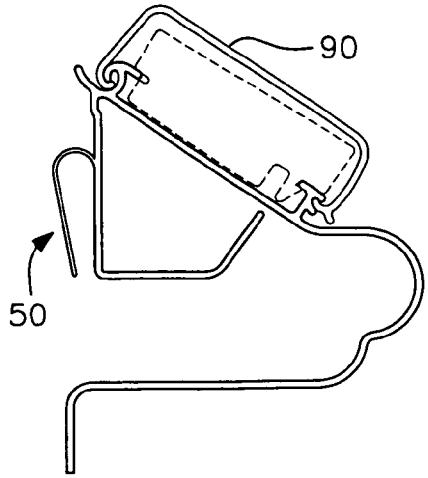
Figure 8C:
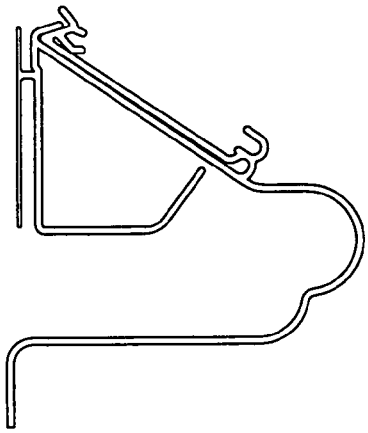
Figure 8D:
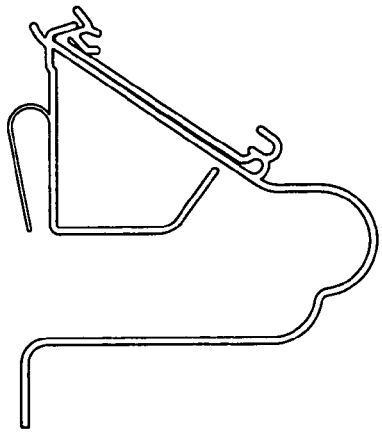
Figure 8E:
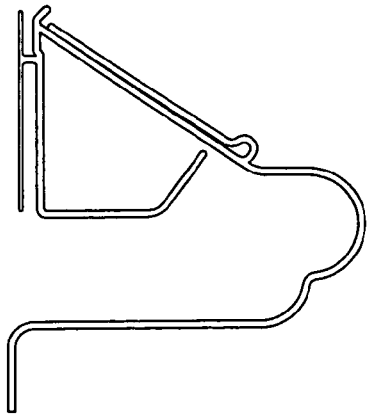
Figure 8F:
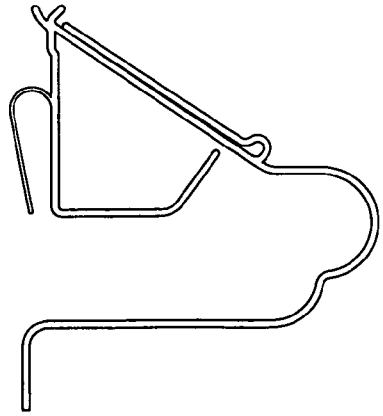

FIGS. 5-7 depict the protective bumper arrangement 60' with a combined label/sign holder 2' of the type shown in U.S. Pat. No. 6,568,112, incorporated herein by reference. This is commercially known as the OMNI™ system manufactured by Fast Industries, Ltd. As is known in the art, this combined label/sign holder 2' may be open to receive labels and, when closed, can receive signs in the topmost plate. Otherwise, the holder 2' is identical to that described with respect to the embodiment of FIGS. 1-4. As shown in FIG. 5, the attachment member 4' for attaching the label/sign holder to the C-channel is the H-back style similar to that shown in FIGS. 1-4. As shown in FIGS. 6 and 7, the attachment member 4' may be the universal back interface as is known in the art. There, the universal rear flange is compressed during attachment and then expands conforming to the geometry of the C-channel.

It should be appreciated that the label holder can be a standard window holder without the combination with a sign holder. This is schematically shown in FIGS. 8(*e*) and 8(*f*) and is of the type shown in U.S. Pat. No. 5,515,632, incorporated herein by reference.

FIGS. 8(*a*)-8(*f*) are side or end views of the three typical types of label holders; the ESL holder, as shown in FIGS. 8(*a*) and 8(*b*) (shown with a cover 90), the combined label/sign holder as shown FIGS. 8(*c*) and 8(*d*), and the standard window label holder as shown in FIGS. 8(*e*) and 8(*f*). FIGS. 8(*a*), 8(*c*) and 8(*e*) show each of these holders with the H-back interface. FIGS. 8(*b*), 8(*d*) and 8(*f*) show the universal back interface. Otherwise, the holder design with the novel bumper arrangement is identical.

The foregoing descriptions and drawings should be considered as illustrative only of the principles of the invention. As noted, the invention may be configured in a variety of shapes and sizes and is not limited by the dimensions of the preferred embodiment. Numerous applications of the present invention will readily occur to those skilled in the art. Therefore, it is not desired to limit the invention to the preferred embodiments or the exact construction and operation shown and described. Rather, all suitable modifications and equivalents may be resorted to, falling within the scope of the invention.

What is claimed is:

1. A label holder for attachment to merchandise shelving comprising, a label holder structure for holding labels or signs;

an attachment structure integrally formed with the label holder structure for attaching the label holder to the merchandise shelving; and a bumper integrally formed with said label holder structure to protect the label holder against impact, said bumper comprising an arcuate, substantially semi-circular-shaped member, an indented, arcuate section extending from the semi-circular-shaped member, and a substantially planar plate integral therewith extending in a direction toward the shelving;

wherein said label holder structure, attachment structure, and integral bumper are formed from extruded plastic.

2. The label holder of claim 1, further comprising an extension arm substantially perpendicular to the planar plate for contact with said merchandise shelving.

3. The label holder of claim 1, wherein said label holder structure includes a means for holding an electronic shelf label (ESL).

4. The label holder of claim 1, wherein said label holder structure including a backing plate and a window integral therewith for receiving a label between the backing plate and the window.

5. The label holder of claim 4, wherein the window includes a sign holder structure.

6. The label holder of claim 1, wherein the attachment structure includes an H-back mounting structure.

7. The label holder of claim 1, wherein said attachment structure is a universal back interface.

8. A label holder for attachment to merchandise shelving comprising, a label holder structure for holding labels or signs;

an attachment structure integrally formed with the label holder structure for attaching the label holder to the merchandise shelving; and a bumper integrally fonned with said label holder structure to protect the label holder against impact, said bumper comprising an arcuate. substantially semi-circular-shaped member, said label holder structure, attachment structure, and integral bumper formed from extruded plastic, wherein said label holder structure includes a back mounting plate for supporting the labels and having a top portion and a bottom portion, said bottom portion integral with said bumper and said top portion integral with a rear support stop member for limiting movement of the back mounting plate in a direction opposite to impact, wherein said rear support stop member is substantially L-shaped with one leg of the L integral with the top portion of the back mounting plate and the other leg of the L having a free end spaced from the rear of the back mounting plate to receive the back mounting plate when impacted.

9. A plastic extruded label holder for attachment to merchandise shelving comprising, a label holder structure for holding electronic shelf labels (ESL's);

an attachment structure integrally formed with the label holder structure for attaching the label holder to the merchandise shelving; and a bumper integrally formed with said label holder structure including a substantially arcuate bulbous section extending in a direction away from the label holder structure, said bulbous section merging with a substantially planar plate extending back toward the attachment structure and integrally joined with a substantially vertical plate that is contactable with the merchandise shelving.

10. The plastic extruded label holder of claim 9, further comprising a rear support stop member for limiting rearward movement of said label holder structure when said bumper is impacted.

11. The plastic extruded label holder of claim 9, further comprising an indentation formed between said bulbous section and said substantially planar plate.

* * * * *